US005732484A

United States Patent [19]

Grutza et al.

[11] Patent Number: 5,732,484

[45] Date of Patent: Mar. 31, 1998

[54] SHOE CLEATS AND METHODS OF PRODUCING AND UTILIZING SAME

[75] Inventors: Zigmund R. Grutza; Hank Deutschendorf, both of Northville; Alan Davis, Canton; Theodore Grutza, Howell, all of Mich.

[73] Assignee: DI-Coat Corporation, Novi, Mich.

[21] Appl. No.: 715,600

[22] Filed: Sep. 18, 1996

[51] Int. Cl.[6] ..... A43B 5/00; A43C 15/02

[52] U.S. Cl. ..... 36/127; 36/134; 36/67 D

[58] Field of Search ..... 36/59 R, 59 A, 36/59 B, 127, 62, 67 D, 134

[56] References Cited

U.S. PATENT DOCUMENTS

| | | | |
|---|---|---|---|
| 586,452 | 7/1897 | Norman | 36/59 A |
| 1,165,235 | 12/1915 | Emery | 36/59 A |
| 1,350,839 | 8/1920 | Rendle | 36/59 B |
| 3,583,082 | 6/1971 | Jordan, Jr. | 36/134 X |
| 3,768,183 | 10/1973 | Fessenden | 36/67 R |
| 4,160,331 | 7/1979 | Bell | 36/59 B |
| 4,702,021 | 10/1987 | Cameron | 36/59 R X |
| 4,779,360 | 10/1988 | Bible | 36/7.7 |
| 5,259,129 | 11/1993 | Deacon et al. | 36/134 X |
| 5,396,717 | 3/1995 | Bell | 36/7.3 |
| 5,485,687 | 1/1996 | Rohde | 36/59 R X |

FOREIGN PATENT DOCUMENTS

| | | | |
|---|---|---|---|
| 807754 | 1/1937 | France | 36/67 D |
| 2529027 | 1/1977 | Germany . | |
| 12126 | of 1895 | United Kingdom | 36/67 A |
| 24348 | of 1896 | United Kingdom . | |
| 2814 | of 1913 | United Kingdom . | |
| 125571 | 4/1919 | United Kingdom . | |
| 390369 | 4/1933 | United Kingdom | 36/59 B |
| 2223394 | 4/1990 | United Kingdom . | |

*Primary Examiner*—Ted Kavanaugh

*Attorney, Agent, or Firm*—Weiner, Carrier, Burt & Esser, P.C.; William F. Esser; Irving M. Weiner

[57] ABSTRACT

A shoe cleat for an athletic shoe. The shoe cleat comprises a first end which removably attaches to the underside of a shoe; a second end which is connected to the first end of the shoe cleat and which includes a surface which engages with a ground surface when the shoe cleat is attached to a shoe; and wherein the ground-engaging surface of the second end of the shoe cleat includes an anti-slip surface.

22 Claims, 1 Drawing Sheet

FIG 1
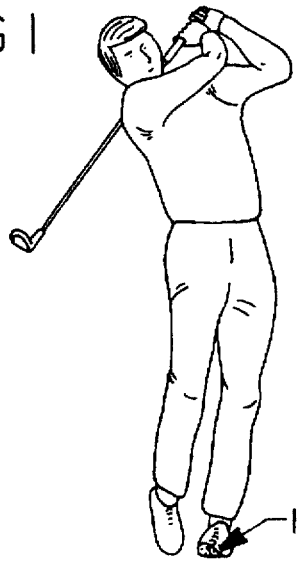
FIG 2
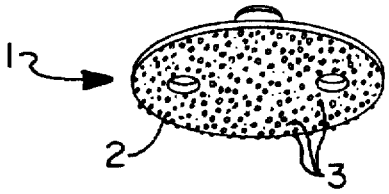
FIG 3
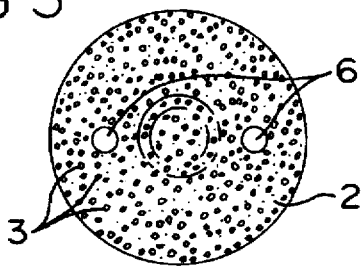
FIG 4
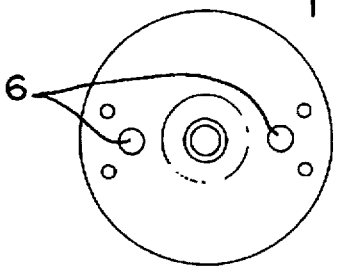
FIG 5
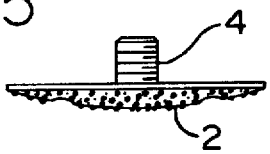
FIG 6
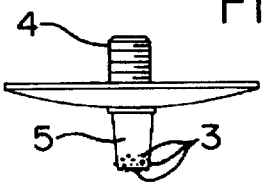
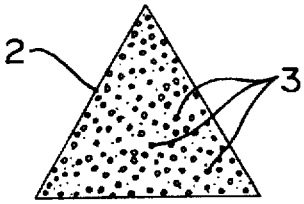
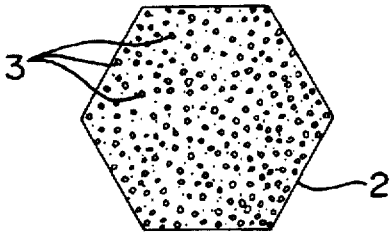
FIG 7

SHOE CLEATS AND METHODS OF PRODUCING AND UTILIZING SAME

BACKGROUND OF THE INVENTION

1. Field of Invention

This invention pertains to a traction device for attachment to the underside of a shoe, and particularly to a cleat for a golf shoe which includes a ground-engaging surface having an increased coefficient of friction.

2. The Relevant Art

Shoes having metal or substantially rigid spikes are known in the sporting goods industry. The metal spikes provide improved traction between the shoe and certain ground surfaces. Shoes having metal spikes, however, leave puncture marks which are greatly disfavored on playing surfaces such as putting greens of golf courses, and provide substantially no traction on hard, substantially smooth surfaces such as tile or asphalt.

Recently, rubber shoe spikes have been created which substantially reduce the adverse affects metal spikes have on golf course putting greens. These shoes having softer, rubber spikes, though, make it very difficult for the wearer to walk on many wet and dry surfaces, such as brick, tile, concrete, asphalt, wood and grass, because the rubber spikes tend to have little frictional engagement therewith. Further, softer, rubber spikes wear much faster than metal spikes. As a result, there is a need for providing a substantially long-lasting athletic shoe cleat which provides substantial traction on surfaces that are commonly encountered while participating in a variety of outdoor sporting events, such as while golfing, while substantially preventing putting greens or other surfaces from becoming substantially damaged.

SUMMARY OF THE INVENTION

The present invention overcomes the above-discussed limitations and shortcomings of known shoe spikes and satisfies a significant need for shoe cleats which provide enhanced traction on a variety of surfaces substantially without adverse affects thereto.

According to the invention, there is provided a shoe cleat having a first end which attaches to the underside of a shoe; a second end which is connected to the first end and which extends outwardly therefrom so that it engages with a ground surface when the shoe is adorned; and wherein the ground-engaging surface of the second end includes a coating of substantially wear-resistant particles so as to form an anti-slip ground-engaging surface. In a first preferred embodiment of the present invention, the substantially wear-resistant particles comprise a plurality of diamonds which are bonded to the ground-engaging surface of the shoe cleat using an electroplating process.

In one embodiment of the present invention, the second end of the cleat comprises a plate member having an enlarged, convex, ground-engaging surface so that penetration in soil is substantially eliminated.

In use, the diamond-coated shoe cleats are attached to the underside of a shoe. Thereafter, the wearer is able to walk over virtually any type of surface without experiencing a substantial loss of traction. In addition, ground surfaces which are more sensitive to pedestrian traffic, such as golf course putting greens, are substantially unaffected by the wearer walking thereon, as each of the shoe cleats provides a substantial support surface to substantially prevent any penetration into the ground surface.

It is an object of the invention to provide a shoe cleat which creates a substantial frictional engagement between a shoe and a ground surface.

Another object of the present invention is to provide such a cleat which has substantially little effect on putting greens.

It is another object of the present invention to provide a cleat which has an increased usable life.

Still another object of the present invention is to provide a shoe cleat which provides a substantially frictional engagement between the shoe and a wide variety of ground surfaces.

Other objects, advantages and salient features of the present invention will become apparent from the following detailed description, which, when taken in conjunction with the annexed drawings, disclose preferred embodiments of the present invention.

BRIEF DESCRIPTION OF THE DRAWINGS

FIG. 1 is a view of the present invention in association with a golf shoe.

FIG. 2 is a perspective view of a preferred embodiment of the present invention.

FIG. 3 is a bottom plan view thereof.

FIG. 4 is a top plan view thereof.

FIG. 5 is a side elevational view thereof.

FIG. 6 is a side elevational view of another preferred embodiment of the present invention.

FIG. 7 is a bottom plan view of other preferred embodiments of the present invention.

DETAILED DESCRIPTION OF THE PREFERRED EMBODIMENTS

Referring to FIGS. 1–5, there is shown a shoe cleat 1 according to the present invention, comprising a first end portion which is selectively engaged with a shoe underside, a second end portion which is connected to the first end portion and which engages with a ground surface, and wherein the second end portion provides an enhanced frictional engagement between a shoe and a ground surface.

Cleat 1 is preferably but not necessarily constructed from a strong and rigid compound, such as steel. Alternatively, cleat 1 is constructed from another metal.

The first end portion of cleat 1 includes a means for removably attaching cleat 1 to an athletic shoe, such as a golf shoe. As shown in FIG. 5, the shoe attaching means preferably includes a threaded end 4 which is sized for engagement with the threaded opening of a golf shoe or the like. When secured to the shoe, cleat 1 extends substantially downwardly therefrom for engagement with a ground surface.

The second end portion of cleat 1 preferably but not necessarily provides an enhanced frictional engagement between the shoe and the ground surface substantially without leaving any cleat marks thereon. As shown in FIGS. 2–5, the second end portion of cleat 1 preferably includes a means for preventing the cleat from penetration into soil, comprising plate member 2 having a plurality of wear-resistant particles 3 disposed thereon. Plate member 2 preferably but not necessarily includes an enlarged ground-engaging surface area so as to substantially avoid penetration into soil. In one preferred embodiment of the present invention shown in FIG. 3, the ground-engaging surface of plate member 2 is substantially circular, having a diameter of approximately one inch. In other preferred embodiments, the ground-engaging surface of plate member 2 includes other shapes, such as a triangular, pentagonal, or hexagonal shape (FIG. 7).

As shown in FIG. 5, the ground-engaging surface of plate member 2 is preferably convex, with the corresponding concave surface thereof being connected to threaded end 4. In this way, cleat 1 will roll to some extent in substantially any direction in response to the walking motion, so that the cleated shoe has the feel and flexibility of a cleatless shoe. Plate member 2 of the preferred embodiments also includes two apertures 6 defined therethrough (FIGS. 3 and 4) so that cleat 1 may be substantially tightened onto a shoe using a wrench that is typically used to tighten cleats and shoe spikes.

The preferred embodiments of the present invention preferably includes a plurality of particles 3 disposed along the convex, ground-engaging surface of plate member 2. The particles are preferably sized and distributed substantially evenly along the ground-engaging surface of plate member 2 so that a substantial anti-slip engagement is formed between the shoe and the ground. In a preferred embodiment of the present invention, particles 3 are sized between approximately 20 and 100 mesh.

Particles 3 are preferably made of a substantially wear-resistant compound so that cleat 1 of the present invention may be used to provide an anti-slip surface for an extended period of time. In a preferred embodiment of the present invention, particles 3 are comprised from artificial diamonds. In other preferred embodiments, particles 3 are comprised from natural diamond, CBN, tungsten carbide, aluminum oxide or silicon carbide. Alternatively, particles 3 are made from other substantially wear-resistant compounds. In order to provide a longer lasting cleat, particles 3 are preferably susceptible to fracture so as to create new cutting edges when in use over a period of time, rather than particles 3 which merely become polished or worn so as to substantially reduce their anti-slip capability.

The present invention includes a means for bonding particles 3 along the ground-engaging surface of plate member 2 so that a substantial portion of each particle 3 remains substantially exposed for contacting the ground and thereby providing a substantial frictional engagement therewith. Particles 3 are preferably but not necessarily combined with a matrix and bonded to plate member 2. In a preferred embodiment of the present invention, particles 3 are bonded to the surface of plate member 2 using an electrodeposition process, such as an electroplated nickel process. Alternatively, particles 3 are bonded to the ground-engaging surface of plate member 2 by fusing or brazing particles 3 thereto using a metal-based matrix.

As stated above, cleats 1 of the present invention are adapted to selectively attach along the underside of golf shoes or the like. For some physical activities, such as playing golf, it may be preferable to have varying degrees of abrasiveness along the golf shoe sole. Accordingly, in one preferred embodiment a plurality of cleats 1 having different degrees of abrasiveness are provided. In this way, cleats 1 having a higher degree of abrasiveness are attached to the part of the shoe which is adjacent the toes of the user, and cleats 1 having the lower degree of abrasiveness are attached to the heel part of the shoe.

In this preferred embodiment, different degrees or levels of abrasiveness of cleats 1 may be achieved by varying the size of particles 3 between different cleats 1, by varying the density of particles 3 along the surface of plate members 2 among different cleats 1, or by varying the depth into which particles 3 are imbedded into the matrix and/or coating which is used in bonding particles 3 to plate members 2.

Referring to FIG. 6, there is disclosed another embodiment of the present invention, wherein cleat 1 includes plate member 2 having spike 5 extending therefrom, and particles 3 being disposed along an end portion of spike 5. Cleat 1 having spike 5 is adapted in instances in which an enhanced amount of traction is required, and/or on surfaces in which it is not important if spike 5 punctures or otherwise adversely affects the surface. Particles 3 are preferably disposed along the ground-engaging surfaces of spike 5 so that a substantially slip-free engagement is formed when walking on hardened, substantially impenetratable surfaces.

Although there have been described what are at present considered to be the preferred embodiments of the present invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims rather than the foregoing description.

We claim:

1. A shoe cleat, comprising:

a first end which removably attaches to an underside of a shoe;

a second end which is connected to said first end and which includes a surface which engages with a ground surface when said shoe cleat is attached to a shoe;

said second end of said cleat is constructed from metal;

wherein said ground-engaging surface of said second end comprises an anti-slip surface;

a plurality of substantially wear-resistant particles; and a means for bonding said particles to said ground-engaging surface, comprising a metal-based matrix in which said particles are partially embedded.

2. A shoe cleat as recited in claim 1 wherein:

said anti-slip surface is formed by bonding said plurality of particles to said ground-engaging surface using a brazing process.

3. A shoe cleat as recited in claim 1, wherein:

said particles includes one of a group consisting of diamond, CBN, carbide, aluminum oxide and silicon carbide.

4. A shoe cleat as recited in claim 1, wherein:

said particles comprise synthetic diamonds.

5. A shoe cleat as recited in claim 4, wherein:

said particles are sized between approximately 20 and 100 mesh.

6. A shoe cleat as recited in claim 1, wherein:

said particles are bonded within a matrix along said ground-engaging surface so that a major portion of each of said particles extends outwardly therefrom.

7. A shoe cleat as recited in claim 1, wherein:

said second end comprises a plate member; and said ground-engaging surface comprises a convex surface of said plate member.

8. A shoe cleat as recited in claim 1, wherein:

said particles are electrodeposited onto said ground-engaging surface.

9. A golf shoe kit, comprising:

a pair of golf shoes;

a plurality of golf cleats, each of said golf cleats having a means for selectively attaching to said golf shoes;

each of said golf cleats includes a metallic, ground-engaging surface which provides a substantially frictional engagement with a ground surface when attached to said golf shoe; and said ground-engaging surface includes substantially wear-resistant particles which are partially embedded within a metal-based matrix and bonded thereby to said ground-engaging surface so that a portion of each of said particles extends outwardly therefrom.

10. A kit as recited in claim 9, wherein:

each of said shoe cleats includes a plate member having a substantially convex surface; and said ground-engaging surface comprises said convex surface of said plate member.

11. A kit as recited in claim 9, wherein:

said substantially wear-resistant particles are chosen from the group consisting of diamond, CBN, carbide, aluminum oxide and silicon carbide.

12. A kit as recited in claim 9, wherein:

said substantially wear-resistant particles are sized between approximately 20 mesh and 100 mesh.

13. A kit as recited in claim 9, wherein:

said ground-engaging surface is formed by bonding said plurality of wear-resistant particles thereto using an electrodeposition process.

14. A kit as recited in claim 9, wherein:

each of said golf cleats has a different level of abrasiveness from another of said golf cleats.

15. A kit as recited in claim 9 wherein:

said plurality of substantially wear-resistant particles are brazed onto said ground-engaging surface.

16. A kit as recited in claim 9, wherein:

said wear resistant particles comprise synthetic diamond particles.

17. A shoe cleat, comprising:

a means for attaching said cleat to a shoe;

a means for substantially preventing said cleat from penetrating a ground surface when attached to a shoe;

wherein a surface of said cleat which engages the ground surface includes a metal-based, substantially anti-slip surface:

said substantially anti-slip surface comprises a plurality of wear-resistant particles which are bonded to said surface by a matrix such that a portion of each of said wear-resistant particles extends outwardly from said surface and said matrix; and said wear-resistant particles, said ground-engaging surface of said cleat and said matrix are integrally bonded together to form a unitary member.

18. A shoe cleat as recited in claim 17, wherein:

said wear-resistant particles are brazed onto said surface using said matrix.

19. A shoe cleat as recited in claim 17, wherein:

said wear-resistant particles are electrodeposited onto said surface using said matrix.

20. A shoe cleat as recited in claim 17, wherein: said wear-resistant particles comprise synthetic diamonds.

21. A shoe cleat as recited in claim 17, wherein:

said wear-resistant particles are sized between approximately 20 mesh and 100 mesh.

22. A shoe cleat as recited in claim 9, wherein:

a number of said golf cleats have at least one different level of abrasiveness relative to other of said golf cleats.

* * * * *